US007259651B2

(12) United States Patent
Dudley et al.

(10) Patent No.: US 7,259,651 B2
(45) Date of Patent: Aug. 21, 2007

(54) ENERGY STORAGE COIL

(75) Inventors: Neil Dudley, Chelmsford (GB); Melvyn McGann, Chelmsford (GB)

(73) Assignee: Tyco Electronics UK Ltd., Wiltshire (GB)

( * ) Notice: Subject to any disclaimer, the term of this patent is extended or adjusted under 35 U.S.C. 154(b) by 138 days.

(21) Appl. No.: 11/355,803

(22) Filed: Feb. 16, 2006

(65) Prior Publication Data

US 2006/0186982 A1 Aug. 24, 2006

(30) Foreign Application Priority Data

Feb. 19, 2005 (GB) ..... 0503502.7

(51) Int. Cl.
*H01F 27/28* (2006.01)

(52) U.S. Cl. ..... 336/229; 336/174

(58) Field of Classification Search ..... 336/29, 336/229

See application file for complete search history.

(56) References Cited

U.S. PATENT DOCUMENTS 2,351,604 A 6/1944 Ferrill, Jr.
2,354,331 A * 7/1944 Polydoroff ..... 336/218
2,975,384 A * 3/1961 Geiser ..... 336/77
3,263,191 A * 7/1966 Arvonio et al. ..... 333/24 R
4,236,127 A 11/1980 Scherba
6,094,110 A * 7/2000 Reddy ..... 333/181
2003/0102947 A1* 6/2003 Ho ..... 336/174

FOREIGN PATENT DOCUMENTS

EP 0 626 767 A2 11/1994
EP 1 189 247 A2 3/2002
JP 61256708 A 11/1986

OTHER PUBLICATIONS

Search Report dated May 11, 2005 for Application No. GB0503502.7.

* cited by examiner

*Primary Examiner*—Elvin Enad
*Assistant Examiner*—Joselito S Baisa
(74) *Attorney, Agent, or Firm*—Barley Snyder LLC

(57) ABSTRACT

An energy storage coil comprises a core having an electrical conductor wound thereabout in a plurality of turns. The turns define a main zone and at least one first auxiliary zone extending along the core. The main zone has a first end and a second end. The turns in the main zone overlie one another. The first auxiliary zone is arranged adjacent to the first end of the main zone. The turns in the first auxiliary zone are arranged to provide the first auxiliary zone with lower parasitic capacitance from turn to turn than the main zone.

9 Claims, 4 Drawing Sheets

ENERGY STORAGE COIL

FIELD OF THE INVENTION

This invention relates to an energy storage coil comprising a core having wound thereabout a plurality of turns of an electrical conductor and, more particularly, to an energy storage coil for minimizing unintentional electromagnetic interference (EMI) generated when a current through the coil changes rapidly.

BACKGROUND OF THE INVENTION

The subject of electromagnetic compliance (EMC) has in recent years become very significant, especially in the field of electronics. Many environments now include large numbers of electronic devices, especially personal desktop computers and similar apparatuses. It is known that the power supplies that form a part of such devices switch at exceedingly high frequencies. Such switching causes EMI. Stray EMI can interfere with the correct operation of neighboring apparatuses. The effects of such interference can range from mere inconvenience to users to catastrophic or even life-threatening consequences.

As a result, many governments have passed legislation requiring manufacturers of electronic equipment to limit the amplitude of EMI created by its products and/or to filter the EMI so that it is attenuated in frequency ranges that would otherwise hamper or affect the operation of other devices. In view of these requirements, it has become commonplace to include EMI filters connected in printed circuit boards of power supplies of devices such as desktop computers. It is generally more beneficial, however, to avoid generating EMC than to filter it by additional circuitry. Typically, power supplies use a semiconductor device to switch current through an inductor. At the moment of switch off, the current flowing in the inductor is interrupted, and the voltage across the inductor changes rapidly. The limit on the rate of change of voltage is usually imposed by parasitic capacitances, typically between the wire forming one turn and that forming an adjacent turn, which turns form a resonant circuit with the inductor or part of the inductor. The net effect is to cause energy to be emitted from the circuit at one or more pseudo-resonant frequencies. This spurious energy is in addition to the wanted energy that is transferred to the load. Often the spurious energy is in a frequency band which is controlled by legislative limits.

It is known in the art to replace the regularly spaced windings of a conventional EMI filter toroid with "piled" windings, i.e. windings that overlie one another in a substantially irregular manner, over a major part of the toroid. However, this solution leads to a very large number of small resonant circuits. Thus, the undesirable self-resonances are reduced in energy, but increased in number. It is therefore necessary to apply further filtering or other suppression measures in order to reduce this energy to acceptable levels.

Such windings are commercially available, for example, for power factor correction circuits. An increasing proportion of electronic devices is equipped with power factor correction circuitry. Older devices typically use a rectifier and capacitor combination as an alternating current (AC) to direct current (DC) converter to provide a DC supply for the AC to DC converter that actually powers the device. Despite their simplicity, such AC to DC converters draw large peak currents from the AC supply when the AC voltage is at or near its peak, and little current elsewhere in the cycle. The resulting distortion of the current waveform from an ideal sinusoidal shape causes higher root mean square (RMS) currents in the supply wiring than would be expected from the electrical power drawn by an electronic device.

This effect may not be significant when considering a single device such as a personal computer. On the other hand, it is now commonplace for entire buildings, on completion, to be equipped with large numbers of identical apparatuses, such as a bulk order of identical personal computers. The power factor effects of the plurality of AC to DC converters that such an installation represents are cumulative. Consequently the opening of ego a new call or data centre may for example cause significant supply current distortion, purely as a result of a large number of AC to DC converters being connected to an alternating mains supply.

Electricity companies have for many years sought to eliminate the inefficiency of transmission that this represents. In the case of personal computers, however, it is not readily possible to use the kinds of power factor correction apparatus, such as capacitive shunts, that are suitable for ego electric motors. It follows therefore that there is a need for an improved means of reducing the supply current distortion. Typically this need is met by a switched mode power factor correction circuit that makes the shape of the current waveform substantially the same as, and in phase with, the voltage waveform. As well as its beneficial effects, the power factor correction circuit often gives rise to significant EMI.

BRIEF SUMMARY OF THE INVENTION

The invention is an energy storage coil comprising a core having an electrical conductor wound thereabout in a plurality of turns. The turns define a main zone and at least one first auxiliary zone extending along the core. The main zone has a first end and a second end. The turns in the main zone overlie one another. The first auxiliary zone is arranged adjacent to the first end of the main zone. The turns in the first auxiliary zone are arranged to provide the first auxiliary zone with lower parasitic capacitance from turn to turn than the main zone.

DETAILED DESCRIPTION OF THE INVENTION

Figure 1:
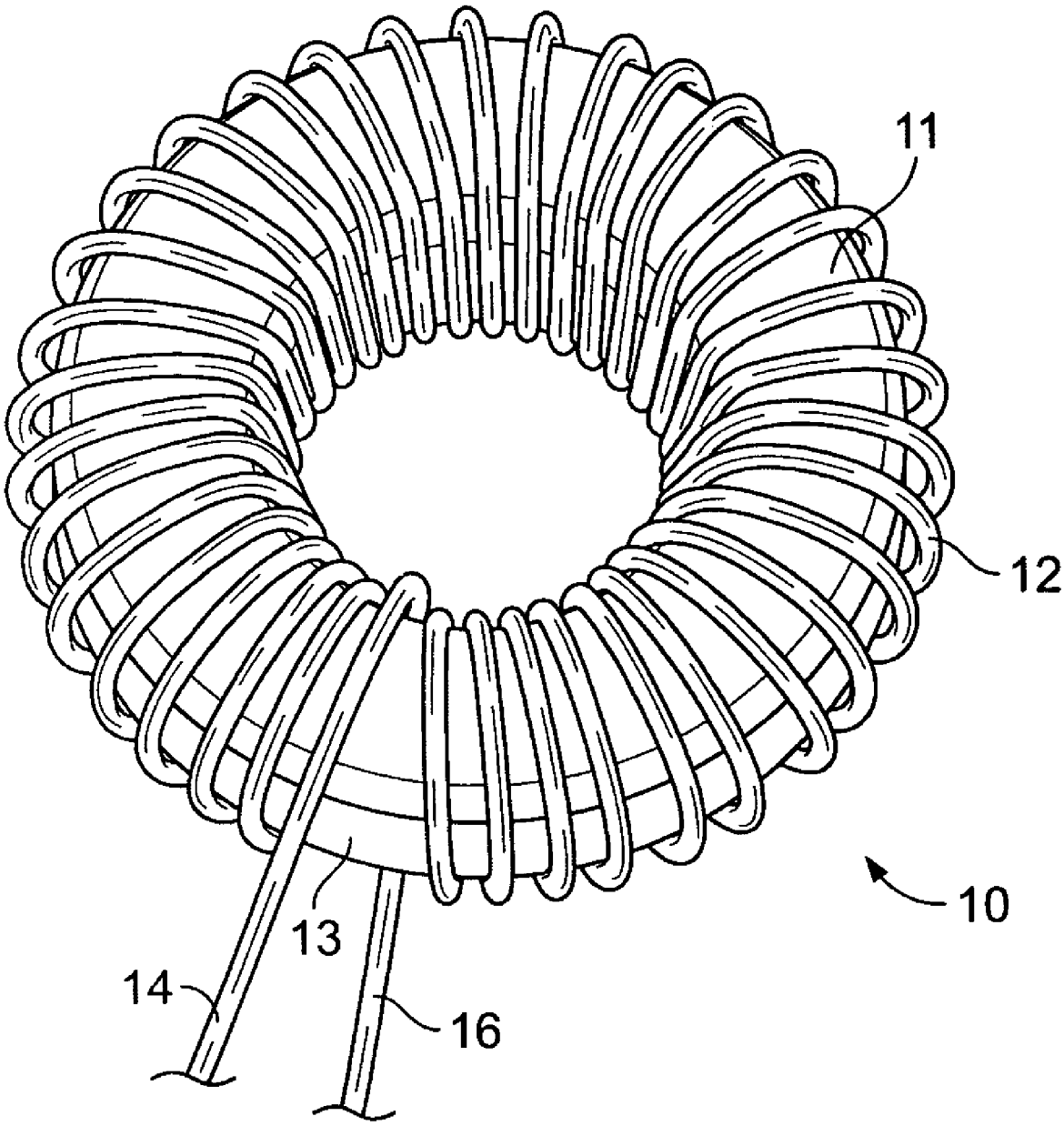
FIG. 1 (Prior Art)
FIG. 1 is a perspective view of a conventional energy storage coil having essentially uniform conductor windings.

FIG. 1 shows a conventional energy storage coil 10. The coil 10 includes a toroidal core 11 having an electrical conductor, such as a copper wire or a metallic alloy wire, coiled through a plurality of turns 12 wound over almost its entire length. The core 11 may be, for example, a solid, ferrite material, such as a sintered ferrite material or a laminated ferrite material. The core 11 may also be in the form of a hollow, toroidal former (manufactured ego from a polymer) that is packed with a powdered, ferritic material. The turns 12 are substantially uniformly and evenly spaced.

The turns 12 of the electrical conductor terminate, for example, at a single interrupted zone 13 where terminal ends 14, 16 of the electrical conductor lead out from the coil 10 to permit operative connection to a switched mode power supply of a device, such as a personal computer. The coil 10 of FIG. 1 suffers from the disadvantages noted hereinabove.

Figure 2:
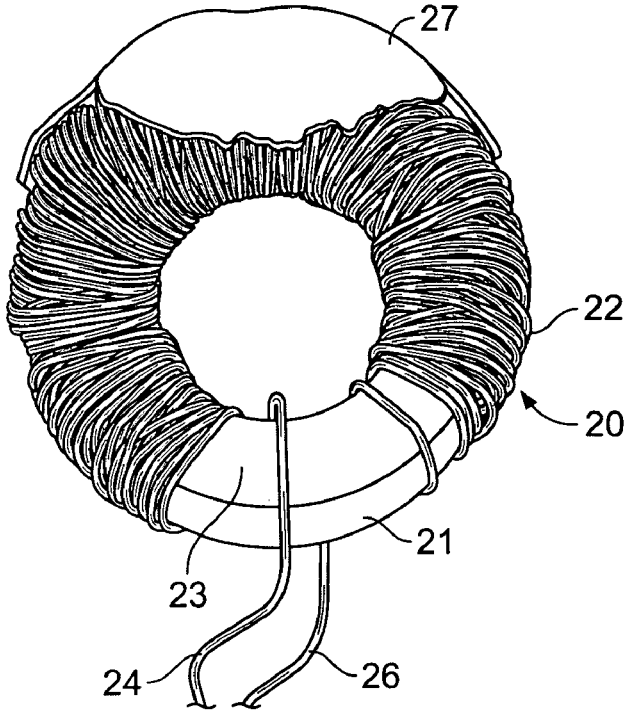
FIG. 2 (Prior Art)
FIG. 2 is a perspective view of another conventional energy storage coil having irregularly piled windings.

FIG. 2 shows another conventional energy storage coil 20. The coil 20 is substantially similar to the coil 10 shown in FIG. 1. The coil 20 includes a toroidal core 21 having an electrical conductor coiled through a plurality of turns 22 wound over almost its entire length. The turns 22 of the electrical conductor terminate, for example, at a single interrupted zone 23 where terminal ends 24, 26 of the electrical conductor lead out from the coil 20. The coil 20 of FIG. 2 differs from the coil 10 of FIG. 1 the turns 22 are overlain one on another in a substantially irregular fashion, as shown in FIG. 2. A protective cover 27 encloses components of the coil 20 except for the terminal ends 24, 26. As noted hereinabove, the average energy of resonance of each resonant circuit defined in the coil 20 is reduced compared with the coil 10 of FIG. 1. On the other hand, the number of resonators is dramatically increased in the coil 20 of FIG. 2, as compared with the coil 10 of FIG. 1. As explained hereinabove, this leads to a requirement for additional filtering and suppression apparatuses.

Figure 3:
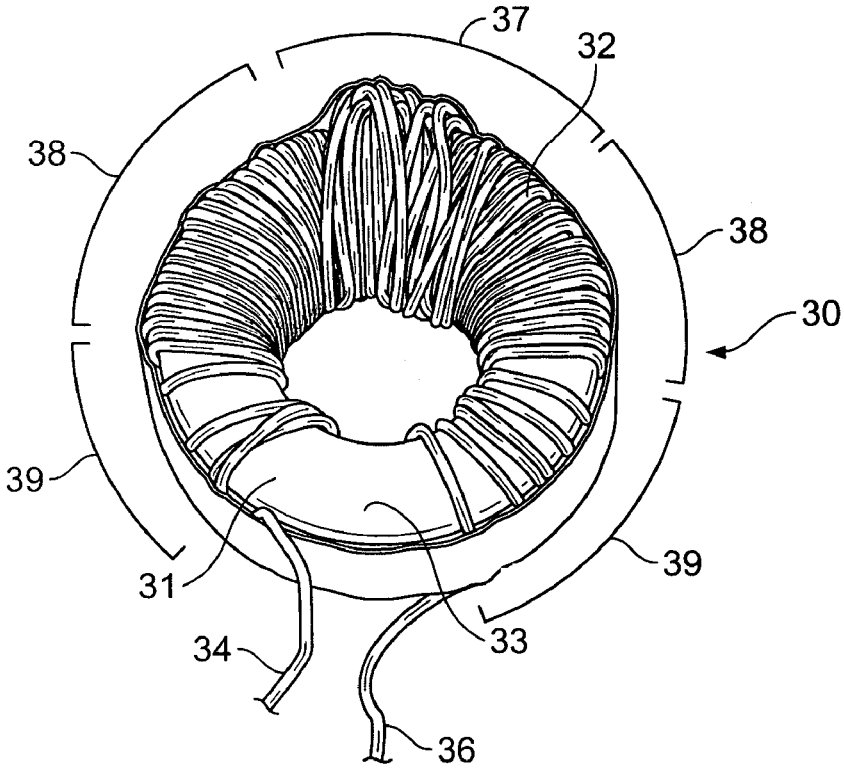
FIG. 3 is a perspective view of an energy storage coil according to the invention.

FIG. 3 shows an energy storage coil 30 in accordance with the invention. The coil 30 includes a toroidal core 31 having an electrical conductor, such as a copper wire or a metallic alloy wire, coiled through a plurality of turns 32 wound over almost its entire length. The core 11 may be, for example, a solid, ferrite material, such as a sintered ferrite material or a laminated ferrite material. The core 31 may also be in the form of a hollow, toroidal former (manufactured ego from a polymer) that is packed with a powdered, ferritic material. The turns 32 of the electrical conductor terminate, for example, at a single interrupted zone 33 where terminal ends 34, 36 of the electrical conductor lead out from the coil 30 to permit operative connection to a switched mode power supply circuit or any of a wide range of other applications.

The turns 32 of the coil 30 are divided into at least two types of zones. The zones include a main zone 37 and first and second auxiliary zones 38, 39, respectively. In the illustrated embodiment, the main zone 37 is arranged on a side of the coil 30 opposite to the interrupted zone 33. At the main zone 37, the turns 32 overlie one another in a substantially irregular fashion, as shown in FIG. 3. Immediately to either side of the main zone 37 are arranged the first auxiliary zones 38. Immediately to either side of the first auxiliary zones 38 are arranged the second auxiliary zones 39. At the first and second auxiliary zones 37, 38, the turns 32 are substantially uniform and substantially equally spaced from one another. The spacings of the turns 32 in the first auxiliary zones 38 are narrower on average than the spacings in the second auxiliary zones 39. In the second auxiliary zones 39 the turns 32 are spaced from each other by typically one or two electrical conductor diameters.

In the coil 30 of FIG. 3, the main zone 37 accounts for approximately 70% of the total number of the turns 32 wound over the core 31, and the main zone 37 occupies approximately 20% of the circumference of the coil 30. Each of the first auxiliary zones 38 accounts for approximately 10% of the total number of the turns 32, and each of the second auxiliary zones 39 accounts for approximately 5% of the total number of the turns 32. Considerable variations of the above-indicated proportions of the coil 30 are possible within the scope of the invention. It will be apparent to the worker of skill in the art how to embody such variants.

In the coil 30 of FIG. 3, the main zone 37 is flanked immediately on either side by the first auxiliary zones 38 of regular, relatively narrowly-spaced turns 32 that are serially connected to the second auxiliary zones 39 of regular, relatively broadly-spaced turns 32. In alternative arrangements, however, the first and second auxiliary zones 38, 39 may be reversed on each side of the main zone 37, such that the relatively broadly-spaced second auxiliary zones 39 lie immediately adjacent to the main zone 37. In yet a further variant, if the electrical conductor to one side of the main zone 37 is grounded, there may be reduced benefit in providing the first and second auxiliary zones 38, 39 on that side of the main zone 37. Thus, the principles of the invention extend to asymmetric patterns of the main and first and second auxiliary zones 37, 38, 39, as well as the symmetric pattern shown in FIG. 3 and the alterative symmetric pattern described hereinabove.

Figure 4:
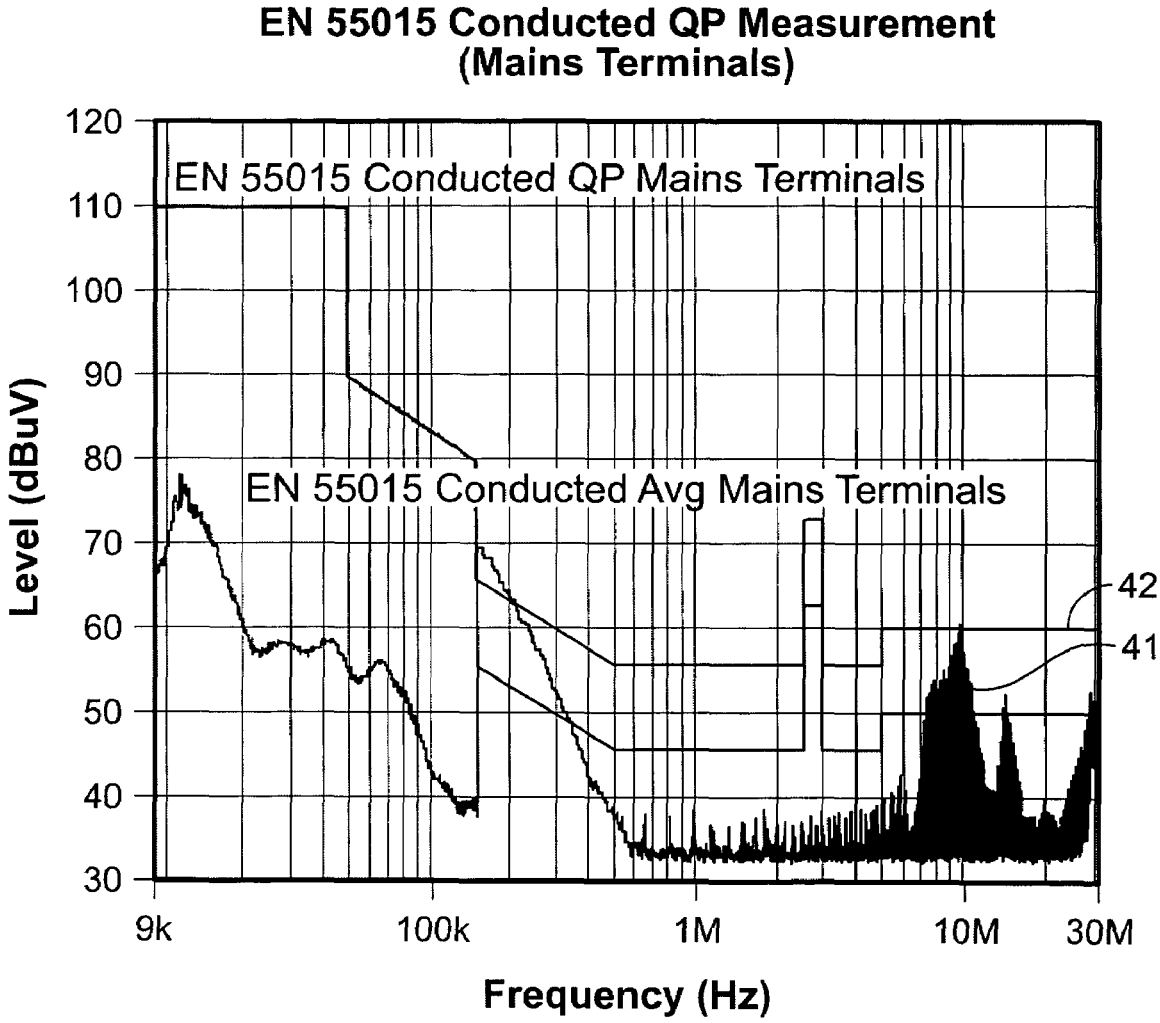
FIG. 4 is a chart showing a frequency response of the coil of FIG. 2.
Figure 5:
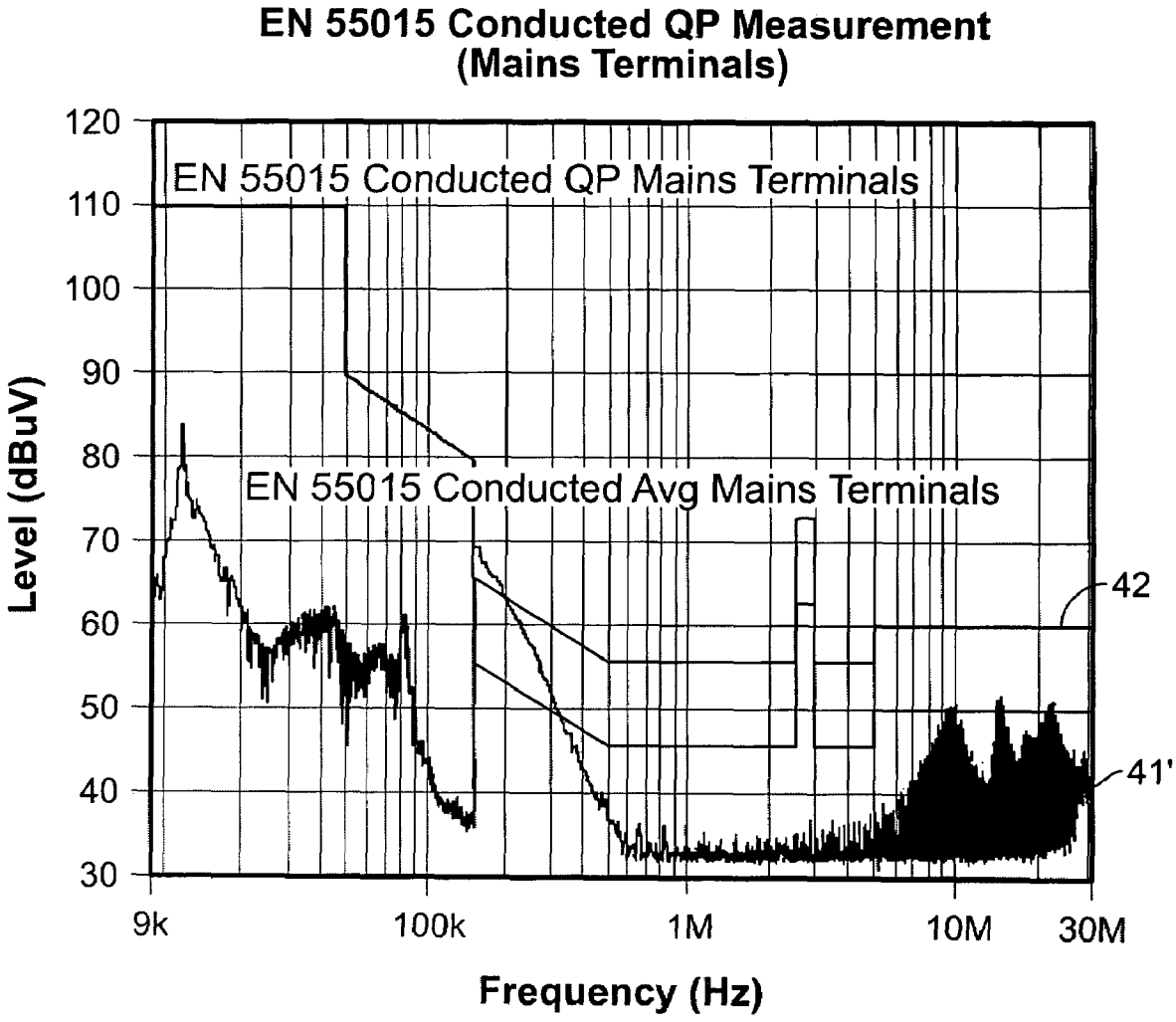
FIG. 5 is a chart showing the frequency response of the coil of FIG. 3.

In the coil 30 according to the invention, high-frequency spurious oscillation energy generated in the main zone 37 is attenuated by the combination of the first and second auxiliary zones 38, 39 before it reaches the remainder of the circuit in which the coil 30 is connected, as illustrated by the data in FIGS. 4 and 5. This arrangement is particularly advantageous in the case of the core 31 of the type used for power factor correction circuits of less than about 1 kW rating, since it allows for attenuation of the spurious resonances on either side of the main zone 37. The invention offers a marked improvement over the spurious EMI generating properties of irregularly wound coils by combining several coils onto the same magnetic core. The invention can also be applied in other areas of switched mode power supplies, or indeed more widely where spurious resonant frequencies are generated by virtue of rapidly changing currents in inductors.

In the illustrated embodiment, the first auxiliary zones 38 lie closer than the second auxiliary zones 39 to the main zone 37. However, in an alternative arrangement the or each of the first auxiliary zones 38 may lie further than the second auxiliary zones 39 away from the main zone 37. It has been found that coils 30 manufactured in accordance with the principles of the invention are effective at attenuating undesirable resonances, regardless of whether the first auxiliary zones 38 or the second auxiliary zones 39 lie closest to the main zone 37.

FIG. 4 is a chart showing the frequency response of the coil 20 of FIG. 2. Shaded zone 41 illustrates the frequency response in the 1 MHz–30 MHz frequency range. The zone 41 shows that the peak excitation of the coil 20 around the 20 MHz frequency achieves an amplitude exceeding a limit line 42 (i.e. the upper, dark line). Thus, the oscillation exceeds a regulatory or design limit.

FIG. 5 is a chart showing the frequency response of the coil 30 of FIG. 3. In contrast to the coil 20 of FIG. 1, shaded zone 41' corresponding to the frequency response of the coil 30 of FIG. 3 shows on average noticeably lower amplitude peaks. Moreover, in the approximately 20 MHz range, the maximum amplitude is considerably below the limit line 42, which is set at the same level as in FIG. 4. In fact, at all the harmonic frequencies of the coil 30, the resonance peaks are approximately 10 dB below the limit line 42 which in practical terms represents a very significant improvement over the conventional coil 20 of FIG. 2.

The foregoing illustrates some of the possibilities for practicing the invention. Many other embodiments are possible within the scope and spirit of the invention. For example, the core 31 is not limited to the toroidal shape illustrated herein and may alternatively be a different shape, such as a straight, elongated, cylindrical rod shape, dumb-bell shape, E—E shape, etc. Additionally, the core 31 may be solid, sintered, laminated, or hollow and powder-filled. Further, the coil 31 may just have either the first or second auxiliary zones 38, 39 and the turns 32 in such zone do not have to be overlain one on another. It is, therefore, intended that the foregoing description be regarded as illustrative rather than limiting, and that the scope of the invention is given by the appended claims together with their full range of equivalents.

What is claimed is:

1. An energy storage coil, comprising:

a core having an electrical conductor wound thereabout in a plurality of turns, the turns defining a main zone and at least one first auxiliary zone extending along the core;

the main zone having a first end and a second end, the turns in the main zone overlying one another;

the first auxiliary zone being arranged adjacent to the first end of the main zone, the turns in the first auxiliary zone arranged to provide the first auxiliary zone with lower parasitic capacitance from turn to turn than the main zone;

another first auxiliary zone being arranged adjacent to the second end of the main zone; and second auxiliary zones positioned adjacent to each of the first auxiliary zone, the second auxiliary zones having a different number of the turns and a different spacing of the turns than each of the first auxiliary zones and the main zone.

2. The energy storage coil of claim 1, wherein the turns of the main zone overlie one another in an irregular manner.

3. The energy storage coil of claim 1, wherein the turns of the first auxiliary zones are spaced narrower than the turns of the second auxiliary zones and the first auxiliary zones lie closer to the main zone than the second auxiliary zones.

4. The energy storage coil of claim 1, wherein the second auxiliary zones are separated by a zone free of turns.

5. The energy storage coil of claim 1, wherein the second end of the main zone is connected directly to a ground.

6. The energy storage coil of claim 1, wherein the core is toroidal in shape.

7. The energy storage coil of claim 1, wherein the core is of or includes a ferrite core.

8. The energy storage coil of claim 1, wherein the core is of or includes a sintered metal.

9. The energy storage coil of claim 1, wherein the core is laminated.

* * * * *